US006932553B1

(12) United States Patent
Roodenburg et al.

(10) Patent No.: US 6,932,553 B1
(45) Date of Patent: Aug. 23, 2005

(54) MULTIPURPOSE UNIT FOR DRILLING AND WELL INTERVENTION

(75) Inventors: Joop Roodenburg, Delft (NL); Christopher Louis Beato, Missouri City, TX (US); Robert Frodo Van Kuilenburg, Dordrech (NL)

(73) Assignee: Itrec, B.V. (NL)

( * ) Notice: Subject to any disclaimer, the term of this patent is extended or adjusted under 35 U.S.C. 154(b) by 177 days.

(21) Appl. No.: 10/390,228

(22) Filed: Mar. 17, 2003

(51) Int. Cl.[7] ..... E21B 19/00
(52) U.S. Cl. ..... 414/22.51; 166/343
(58) Field of Search ..... 414/22.51; 166/341, 166/343, 352

(56) References Cited

U.S. PATENT DOCUMENTS

| | | | | | |
|---|---|---|---|---|---|
| 3,116,793 | A | | 1/1964 | McStravick | 166/21 |
| 3,658,298 | A | | 4/1972 | Moore | 254/190 |
| 3,714,995 | A | | 2/1973 | Hanes | 175/5 |
| 3,791,628 | A | | 2/1974 | Burns | 254/172 |
| 3,804,183 | A | | 4/1974 | Duncan | 175/5 |
| 3,841,407 | A | | 10/1974 | Bozeman | 166/315 |
| 3,917,230 | A | | 11/1975 | Barron | 254/173 |
| 4,208,158 | A | * | 6/1980 | Davies et al. | 414/22.68 |
| 4,249,600 | A | | 2/1981 | Bailey | 166/77 |
| 4,336,840 | A | | 6/1982 | Bailey | 166/77 |
| 4,341,373 | A | * | 7/1982 | Mouton, Jr. | 254/386 |
| 4,423,994 | A | | 1/1984 | Schefers | 414/22 |
| 4,515,220 | A | | 5/1985 | Sizer | 166/384 |
| 4,570,705 | A | | 2/1986 | Walling | 166/177 |
| 4,620,692 | A | | 11/1986 | Foreman | 254/277 |
| 4,688,764 | A | | 8/1987 | Nayler | 254/277 |
| 4,867,418 | A | | 9/1989 | Daniels | 254/277 |
| 5,291,956 | A | | 3/1994 | Mueller | 175/67 |
| 5,551,803 | A | | 9/1996 | Pallini | 405/223.1 |
| 5,671,811 | A | | 9/1997 | Head | 166/346 |
| 5,839,514 | A | | 11/1998 | Gipson | 166/384 |
| 5,894,895 | A | | 4/1999 | Welsh | 175/5 |
| 6,009,216 | A | | 12/1999 | Pruett | 385/12 |
| 6,065,540 | A | | 5/2000 | Thomeer | 166/297 |
| 6,158,516 | A | | 12/2000 | Smith | 166/385 |
| 6,171,027 | B1 | | 1/2001 | Blankestijin | 405/201 |
| 6,273,188 | B1 | | 8/2001 | McCafferty | 166/77.2 |
| 6,343,892 | B1 | * | 2/2002 | Kristiansen | 405/195.1 |
| 6,361,262 | B1 | | 3/2002 | Roodenburg | 414/22.51 |
| 6,398,457 | B2 | | 6/2002 | Baugh | 405/170 |
| 6,431,286 | B1 | | 8/2002 | Andreychuk | 166/384 |
| 6,502,541 | B2 | | 1/2003 | Abo | 414/22.51 |
| 6,554,075 | B2 | | 4/2003 | Fikes | 166/379 |
| 6,601,649 | B2 | | 8/2003 | Beato | 166/352 |
| 2003/0010505 | A1 | | 1/2003 | Gipson | 166/384 |

FOREIGN PATENT DOCUMENTS

| | | | |
|---|---|---|---|
| GB | 2171974 A | 3/1986 | B66C/13/04 |
| WO | PCT NO98/00342 | 11/1998 | E21B/15/00 |

* cited by examiner

*Primary Examiner*—Khoi H. Tran
(74) *Attorney, Agent, or Firm*—Buskop Law Group, P.C.; Wendy Buskop

(57) ABSTRACT

The invention is a multipurpose system for a drilling and well intervention made of a pivotable, slidable cantilever on a platform adapted to pivot and to slide along an x-y axis; a tower disposed on the cantilever with a mast, a hoist winch, a splittable block connected to the mast, a trolley with a holding member wherein the trolley is moveably mounted to the mast and the splittable block, and a hoist cable that passes over the mast through the splittable block to the trolley; a storage device for storing tubulars; a racking arm secured to the tower for moving tubulars; a reel with coiled tubulars; a moveable injector head for running and retrieving coiled tubulars from the reel; and a retractable trolley moveably mounted on the mast with a holding member and adapted for positioning the tubulars over a well and over an additional work area.

34 Claims, 10 Drawing Sheets

MULTIPURPOSE UNIT FOR DRILLING AND WELL INTERVENTION

FIELD OF THE INVENTION

The invention relates to a multipurpose tower with casing drilling and coil tubing equipment located on a cantilever adapted to pivot and move along an x-y axis for use on a platform or vessel for drilling and well intervention.

BACKGROUND OF THE INVENTION

Drilling rigs have traditionally used immoveable derricks to support hoists on rigs. These derricks have significant safety issues in that equipment or structural elements can become detached and fall on worker's heads. Also, the hoisting action is subject to pitch and yaw of the vessel causing the equipment to become dangerous. A need has existed for a tower with safety advantages that can be disposed on a moveable and pivotable cantilever, particularly for jack-up rigs that have an ability to handle tubulars.

In addition, new emerging technologies such as casing and continuous tubular, or "coiled tubulars", drilling techniques are now ready for commercial application. These techniques, however, are usually not used because there are high costs associated with integrating such equipment into traditional lattice derricks or masts.

A need, therefore, exists for a tower designed effectively use casing and continuous tubular technologies in order to reduce the cost of developing oil and gas reserves.

SUMMARY OF THE INVENTION

The current invention is a multipurpose system for a drilling and well intervention made of a pivotable, slidable cantilever on a platform adapted to pivot and to slide along an x-y axis and a tower disposed on the cantilever. The tower has a mast, a hoist winch, a splittable block connected to the mast, and a trolley with the holding member. The trolley is moveably mounted to the mast and the splittable block. The tower also has a hoist cable that passes over the mast through the splittable block to the trolley.

The multipurpose system also has a storage area with a storage device for storing tubulars, a racking arm secured the pivotable, slidable cantilever and secured with a beam to the tower for moving tubulars, and a reel comprising coiled tubulars. The system also has a moveable injector head for running and retrieving coiled tubulars from the reel and a retractable trolley moveably mounted on the mast with a holding member and adapted for positioning the tubulars over a well and over an additional work area.

The invention also relates to a multipurpose system installed on a jack up rig or fixed platform rig or other types of floating rigs.

BRIEF DESCRIPTION OF THE DRAWINGS

A specific embodiment of the invention will be described by way of example with reference to the accompanying drawings, in which.

The present invention is detailed below with reference to the listed figures.

DETAILED DESCRIPTION OF THE PREFERRED EMBODIMENTS

Before explaining the present invention in detail, it is to be understood that the invention is not limited to the particular embodiments and that it can be practiced or carried out in various ways.

Figure 6:
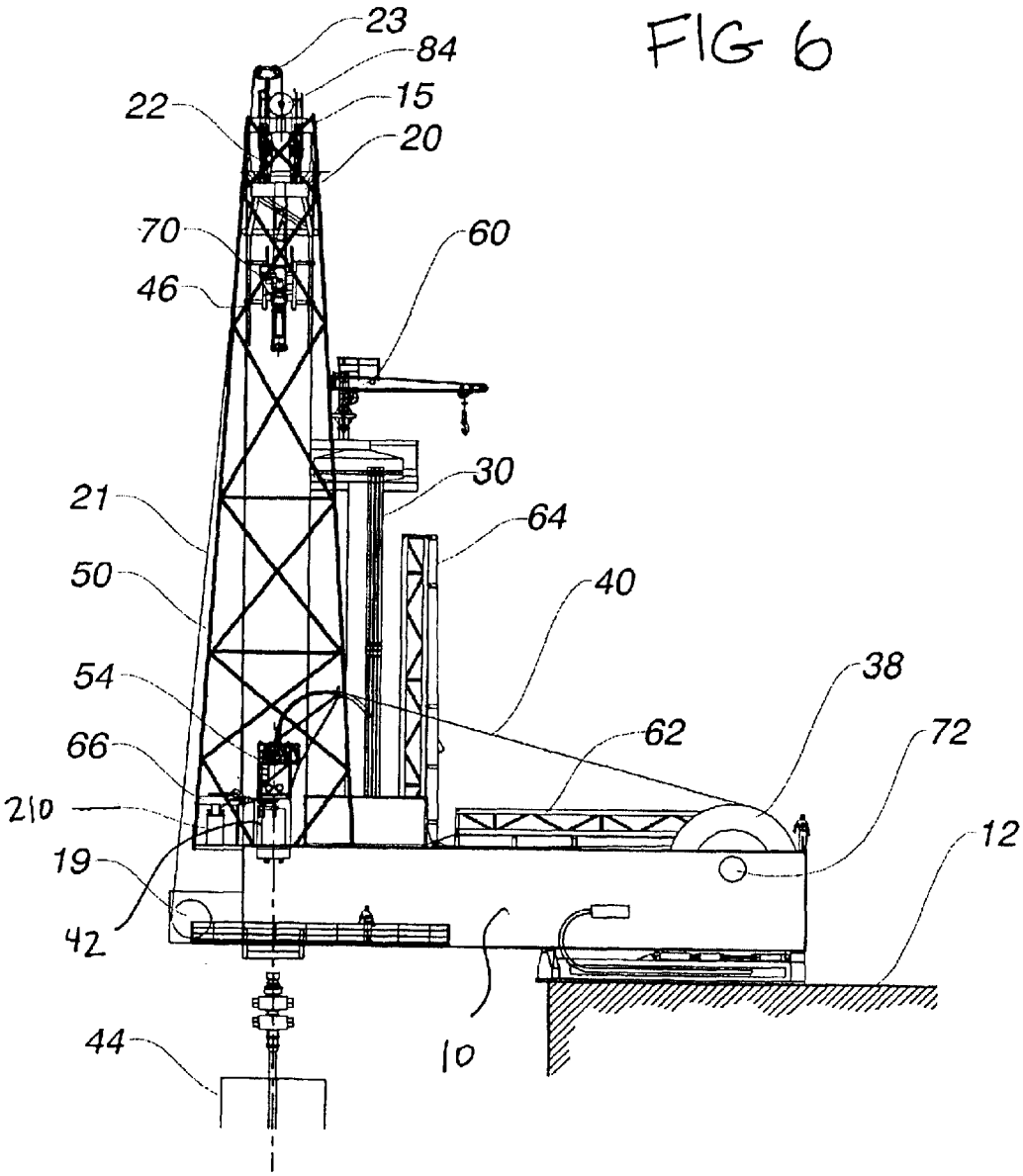
FIG. 6 is a side view of the cantilever with the novel multipurpose system disposed on a derrick.

The present invention is related to a multipurpose system for a drilling and well intervention device. The system includes a pivotable, slidable cantilever 10 on a platform 12 adapted to pivot and to slide along an x-y axis. A tower 14 is located in the cantilever 10. The tower 14 is preferably a tube or sleeve construction but could be constructed using a lattice design. Alternatively, the tower can be a derrick 50, as shown in FIG. 6.

The tower 14 can be of a modular design with the construction made of large components that are welded or fitted together. Typical activities the system is adapted for are casing drilling, coiled tubing operations, off line tubular handling, conventional drilling, conventional well intervention operations and combinations thereof.

Figure 2:
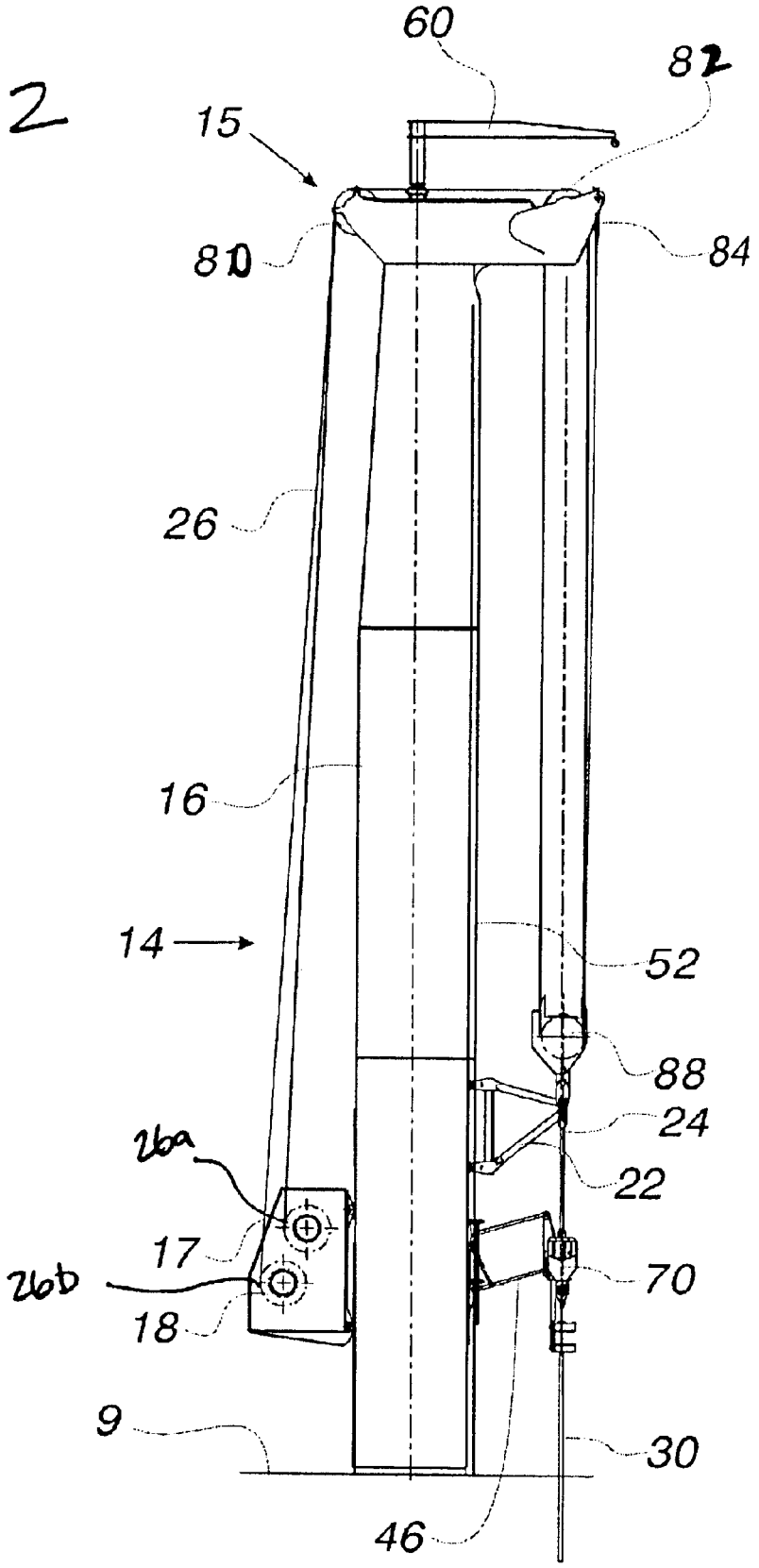
FIG. 2 is a side view of the tower according to the invention.
Figure 7:
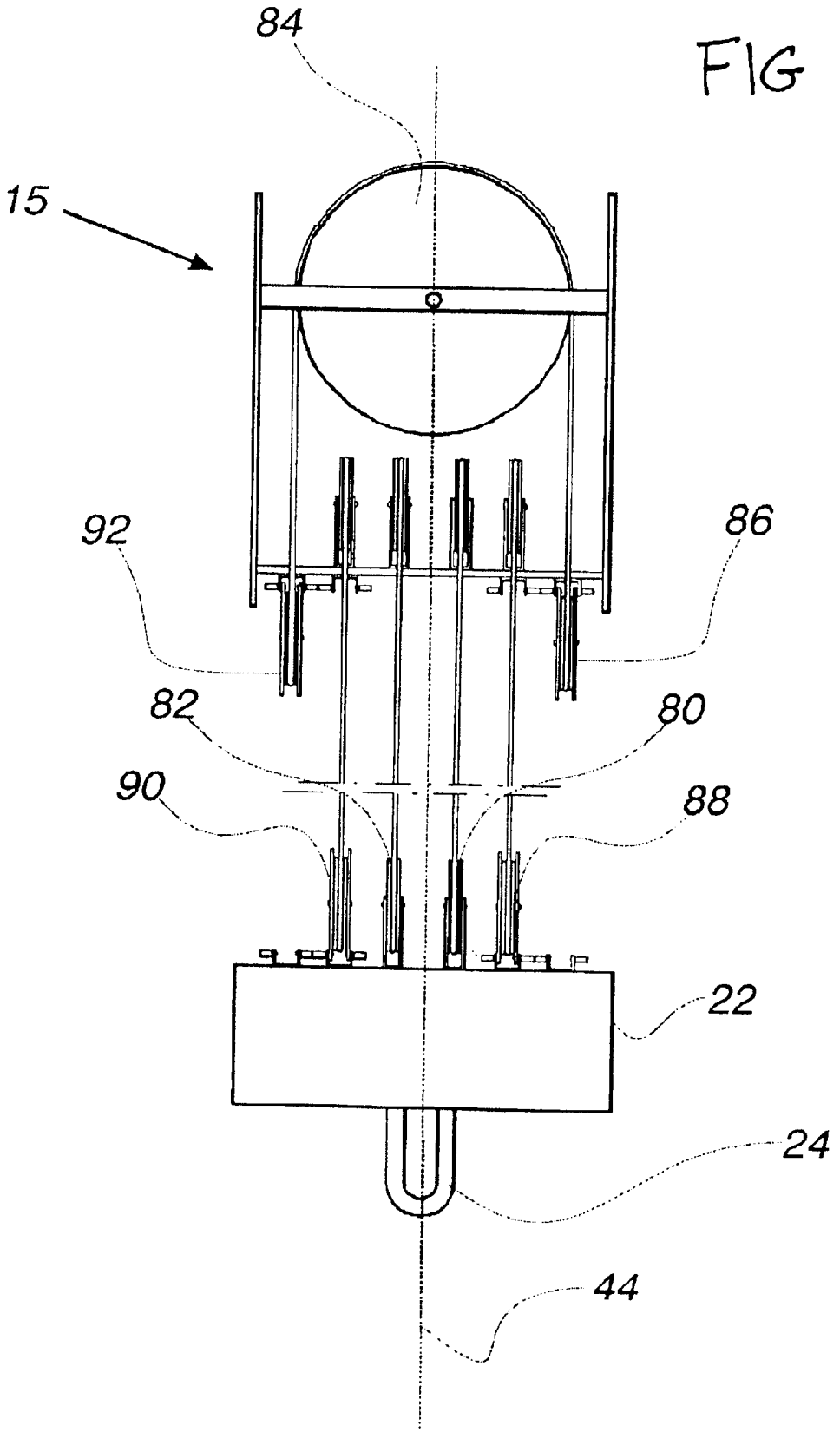
FIG. 7 is a detailed front view of a splittable block usable with the inventive multipurpose system with all the loose pulleys and two fixed pulleys connected to the trolley.
Figure 8:
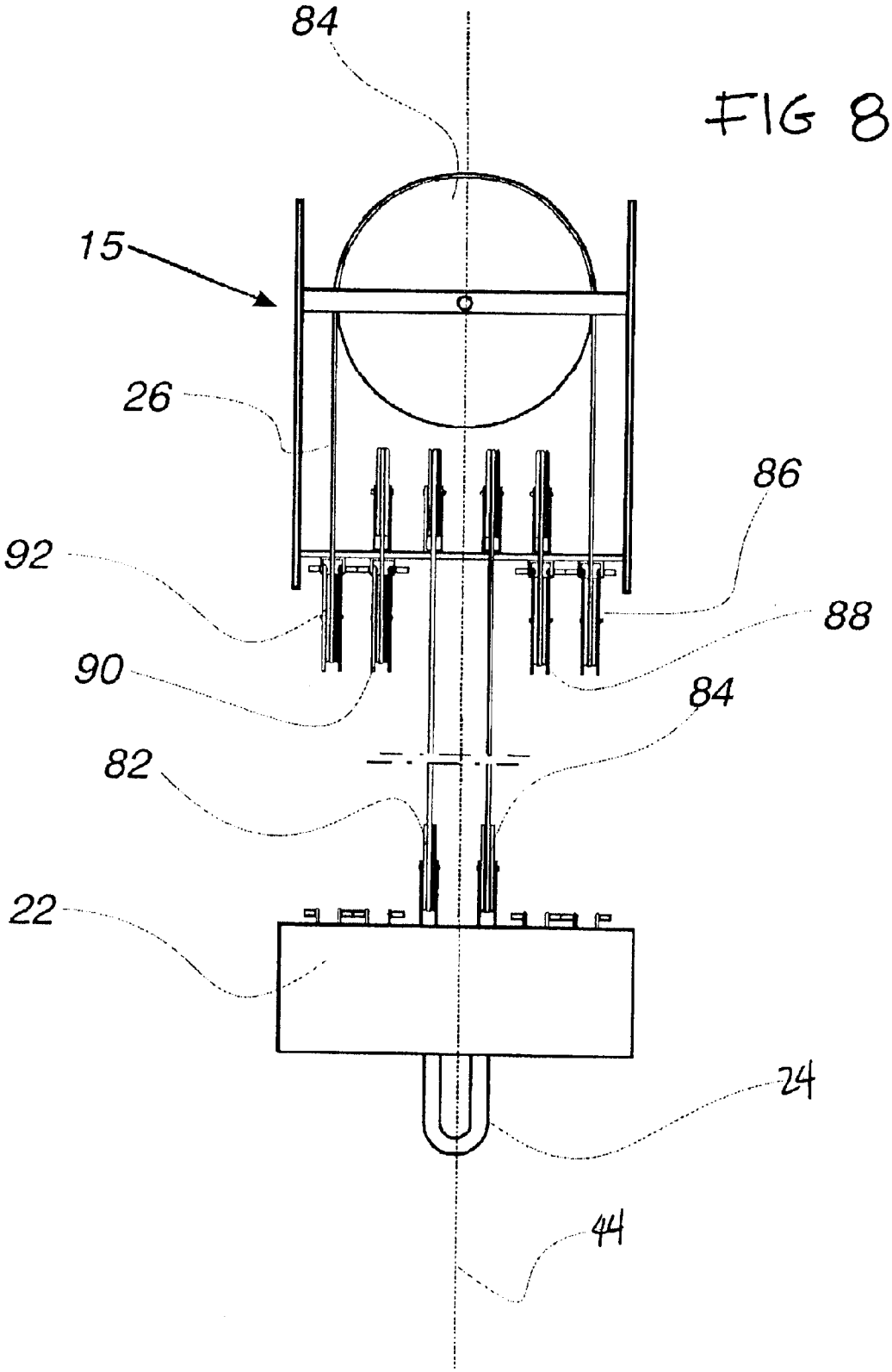
FIG. 8 is a detailed front view of a splittable block according to the invention with only two loose pulleys and two fixed pulleys connected to the trolley.

The tower 14 has located on it at least one splittable block 20 that is made of a combination of fixed pulleys 80, 82, 84 and loose pulleys 86, 88, 90, 92 connected to the tower 14 as shown in FIGS. 7 and 8. A trolley 22 comprising a holding member 24 secured to the splittable block 20 for holding tubulars 30 or casing 98, coiled tubing or similar materials. A hoist winch 18 is disposed on the tower 14 and connected to the splittable block 20. More than one hoist winch 18 can be disposed on the tower 14, such as a second hoist winch 17, as shown in FIG. 2.

Figure 1:
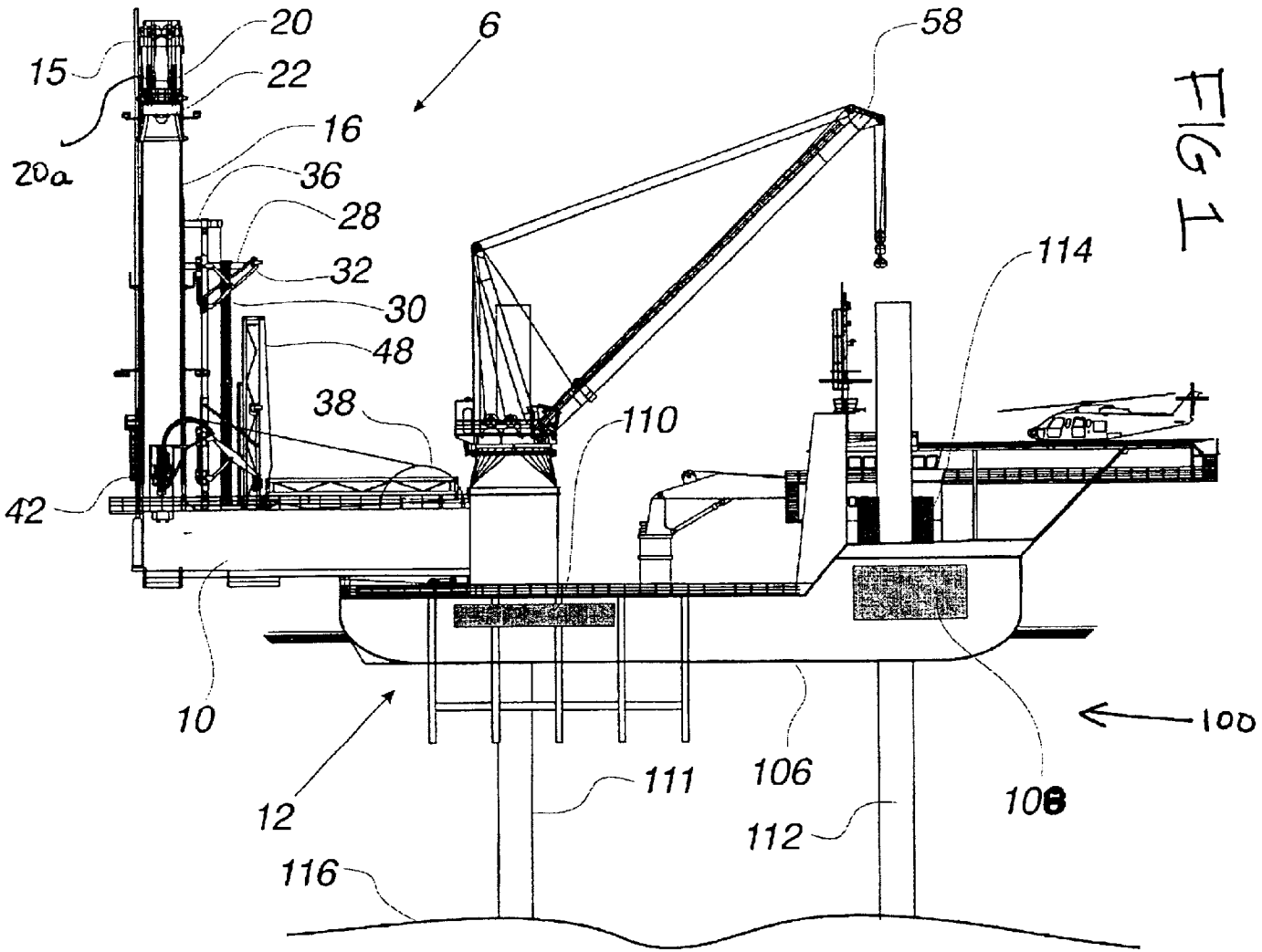
FIG. 1 is a side view of a platform with cantilever showing the multipurpose system of the invention.
Figure 9:
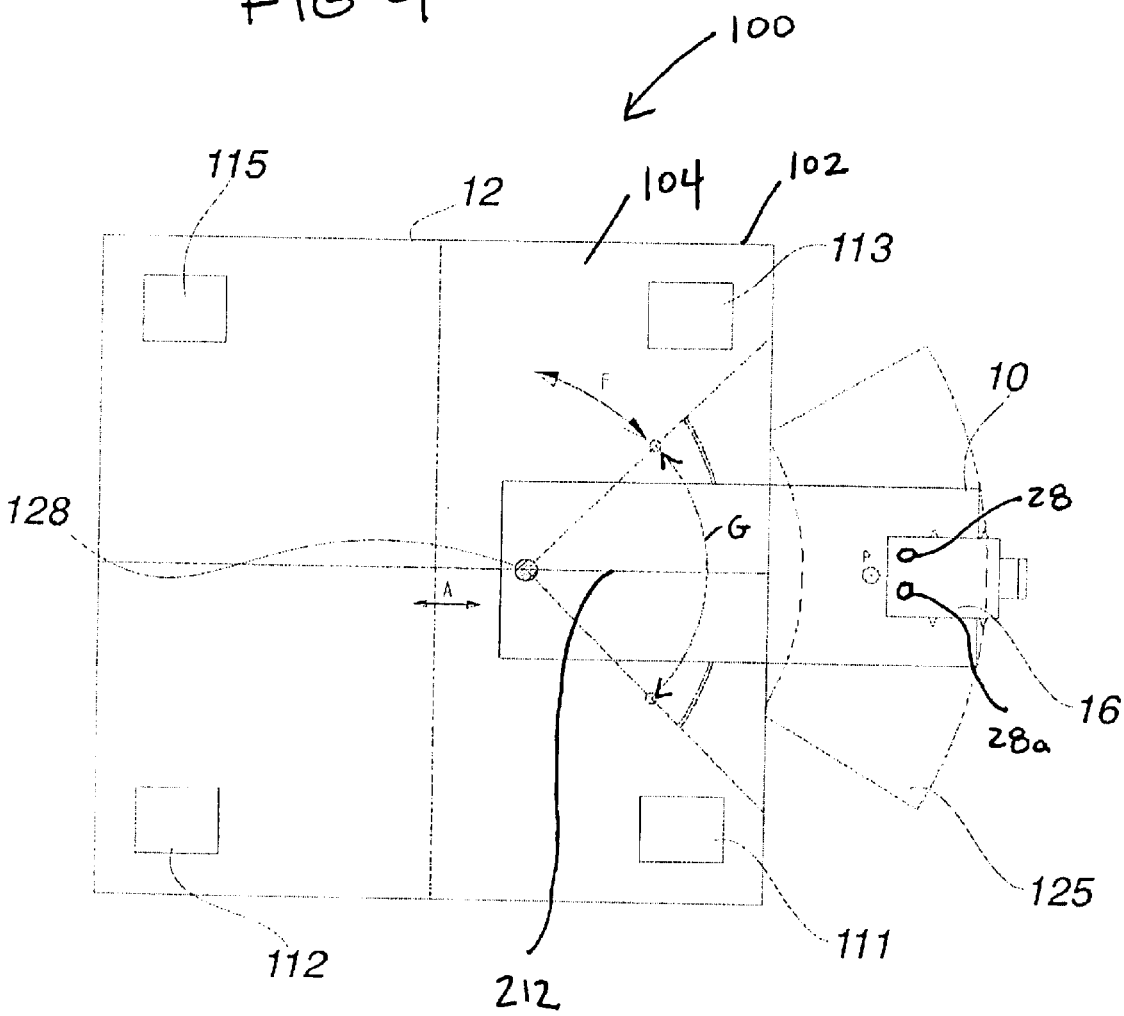
FIG. 9 is a top view of the platform showing the multipurpose system can pivot about a central point on a platform.

FIG. 1 also shows at least one storage device 28 secured to the cantilever 10 for storing tubulars 30. The storage device 28 engages the tower 14 with beam 36. The storage device is most preferably a vertical storage device. FIG. 9 shows that a plurality of vertical storage devices can be used, 28 and 28*a*.

Figure 10:
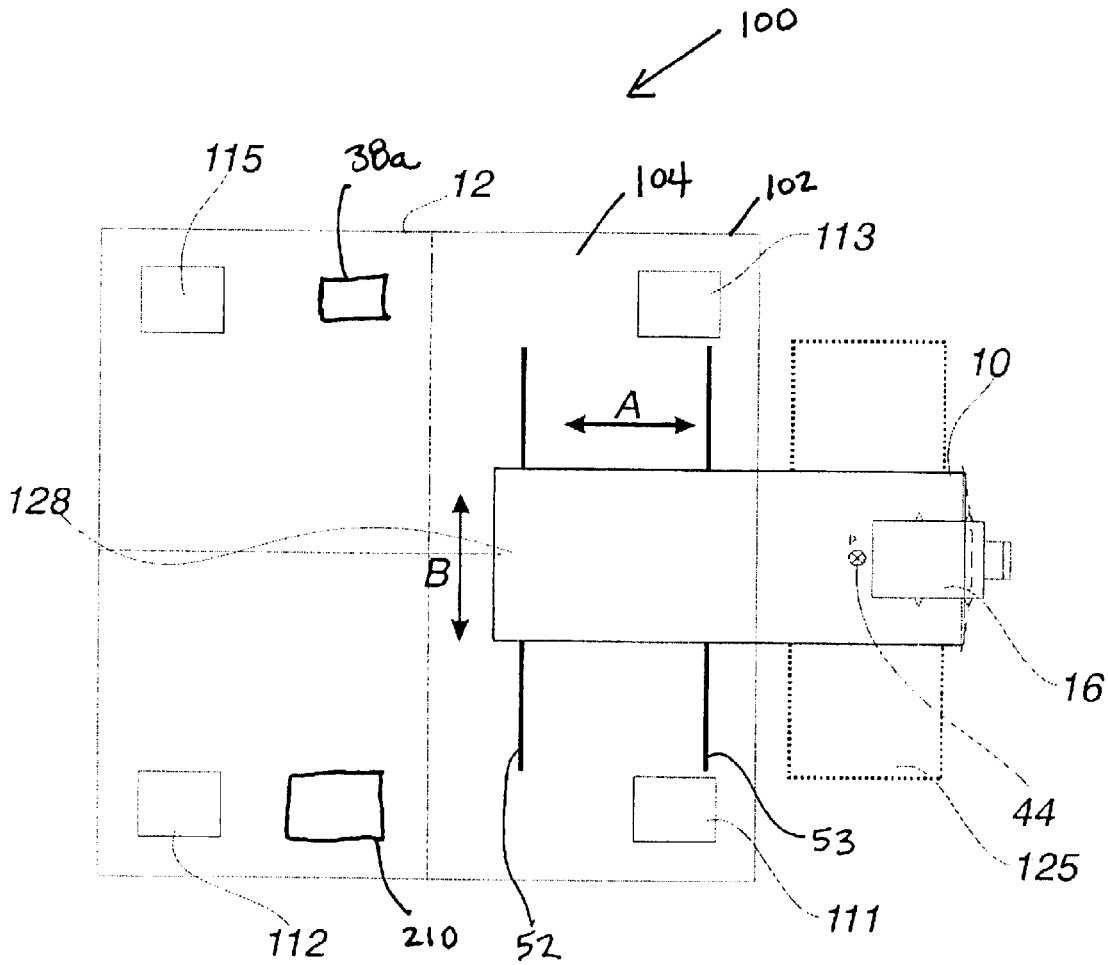
FIG. 10 is a top view of the platform showing the multipurpose system can skid in tow directions.

FIG. 1 also shows a racking arm 32 secured to the cantilever 10 and with a beam 36 to the tower 14 for moving tubulars 30 on the cantilever 10. At least one reel 38 and at optionally two or more reels 38*a* are shown in FIG. 10 can be used with the invention and are removably mounted within the cantilever 10. Each reel is contains coiled tubulars 40.

A moveable injector head 42 is mounted on a sliding frame 54 that is removably mounted on the cantilever 10 for running and retrieving coiled tubulars 40 from the reel 38 for use in a well 44. Also a retractable trolley 46 is moveably mounted on the mast 16 and can optionally connect to the trolley 22 for positioning the tubulars 30 over the well 44 in an extended position, or a first position, and over a work area, such as a mouse hole 48 in a retracted or second position.

Coiled tubulars 40 and tubulars 30 are used synonymously when describing this invention.

Figure 3:
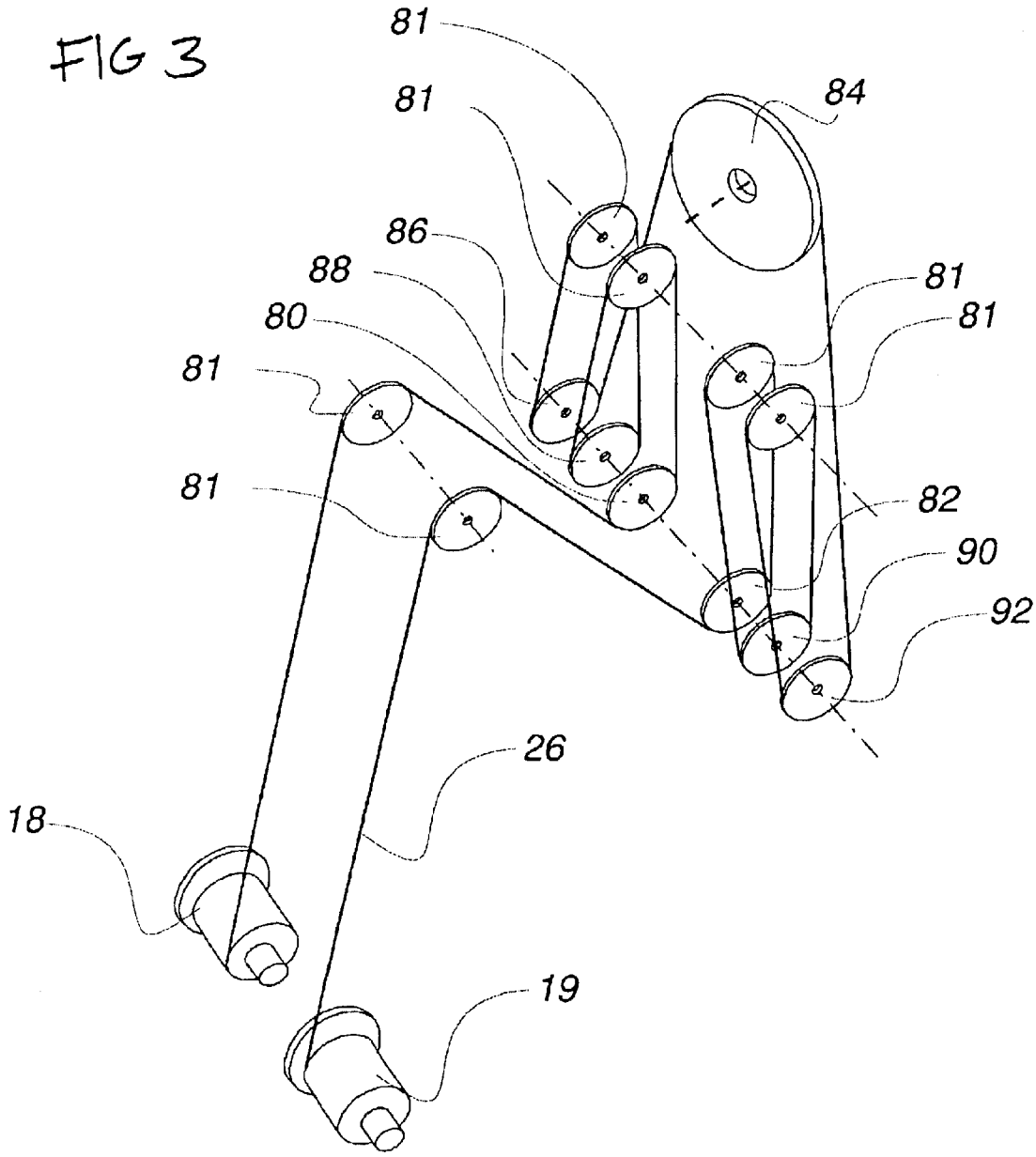
FIG. 3 is a reeving diagram of the splittable block used in the multipurpose system of the invention.

FIG. 3 shows that at least one additional hoist winch 19, such as a down hole assembly retrieval winch, is mounted on the tower 14, or the platform 12, or the cantilever 10. The winch 19 can be used for running yet another hoist cable over the tower 14 and through an opening in the splittable block 20, trolley 22 and mast head 16 for setting or retrieving drilling and well intervention equipment.

A plurality of splittable blocks 20 and 20*a* can be used in the invention as shown in FIG. 1.

Two main hoisting winches 17 and 18 can be used in this invention. If two are used, each end can be wound onto a separate winch. By winding the two ends 26*a* and 26*b* each onto a separate winch 17, 18, as shown in FIG. 2, it is possible to achieve the same hoist cable speed at a relatively low speed of revolution on the winches 17, 18.

This design is novel because it means there is an enormous reduction on the wear of the hoist cable 26. The hoist cable 26, therefore, does not have to be replaced as often, as is experienced with conventional designs. This design also allows hoist cable 25 that has reached its fatigue life to be wound from one winch 18 to the other 17 therefore eliminating the need to slip and cut the fatigued cable from the system thereby reducing operational non productive time.

The invention contemplates that the winch can be driven by a plurality of relatively small motors, each having a low inertia. For example, it is contemplated that the winches can be equipped on both sides with electric motors which engage with a pinion in a toothed wheel of the winch. This design has the advantage that such electric motors are commercially available and no special expensive, hoisting winches are necessary. Also the relatively small motors have a low internal inertia, which means, for example, that when the direction of rotation of the winch is reversed less energy and time are lost during the reversal. This novel design is a significant saving over the known winch and motor designs for this type of tower 14 or derrick 50 construction.

Finding a compromise between speed and power is a known problem for current winch construction. A hoist cable is guided in such a way over the cable blocks in the tower 14 and on the trolley 22 that several cable parts extend between the tower 14 and the trolley 22. In this case, the more wire parts are present between the tower 14 and the trolley 22, the greater the load that can be lifted with the hoisting device if the hoist winch 18 remains unchanged. In the case where more wire parts are present between the tower 14 and the trolley 22, the speed at which the trolley 22 can be moved relative to the tower 14 is much lower.

In order to find a good compromise between speed and lifting power, it traditionally was decided to provide the hoisting device with relatively heavy winches. The heavy winches ensure that the requirement of being able to move the trolley 22 up and down rapidly can be met in every case. This system has problems in that a substantial part of the lifting power is not being utilized for a substantial part of the time. In other words, the known device is actually provided with winches that are too heavy—and therefore too expensive—to be able to reach sufficient speed occasionally.

The invention has been designed to overcome this problem and provide a hoisting device that can lift a relatively heavy load while being operated at a relatively high speed, yet have a light and cheap design.

The invention provides a plurality of loose pulleys 86, 88, 90, and 92 over which the hoist cable 26 can be guided as shown in FIG. 3. The loose pulleys 86, 88, 90, and 92 can be moved between a first position, in which the loose pulleys 86, 88, 90, and 92 are connected to the tower 14, and a second position, in which the loose pulleys 86, 88, 90, and 92 are connected to the trolley 22.

By using the loose pulleys 86, 88, 90, 92 the number of wire parts between the tower 14 and the trolley 22 can be set as desired and minimized. When the loose pulleys 86, 88, 90, 92 are attached to the tower 14, few wire parts will extend between the tower 14 and the trolley 22, and a relatively low weight can be lifted.

It is possible according to the invention for the loose pulleys 86, 88, 90, 92 to be attached symmetrically relative to the center of the tower 14. This symmetrical design ensures that the forces exerted upon the cables are also transmitted symmetrically to a tower 14, which means that no additional bending loads are exerted upon the tower 14.

It is possible according to the invention for the loose pulleys 86, 88, 90, 92 to be accommodated in a housing, which at least on the bottom side is provided with locking elements for fixing the pulleys on the trolley 22. The loose pulleys 86, 88, 90, 92 are pulled automatically into their first position, in contact with the tower 14, by tension in the hoisting cable. It is, therefore, sufficient to provide only the bottom side of the housings with locking elements.

It is advantageous for the locking elements to be equipped with a hydraulic actuation device. The use of a hydraulic actuation device means that the locking pins can be remotely controlled. This feature is particularly advantageous when eliminating safety hazards is a major concern.

FIG. 1 shows a side view of the drilling platform 12 with the hoisting device 6 and crane 58 mounted on the platform 12. Although the preferred embodiment of drilling platform 12 is a jack-up platform other vessels are contemplated as well such as but not limiting to, a barge, a ship and fixed leg platforms. Also visible are cantilever 10 with tower 14 mounted on top of the cantilever 10.

FIG. 1 also shows that the invention is a jack up rig 100 for a well drilling and well intervention and has a substantially plane shaped or planar bottom 106. Using this invention on a jack up is the preferred embodiment.

FIG. 9 shows more detail on the jack up rig 100 embodiment. As can be seen, the jack up has a frame 102 with a working deck 104. FIG. 9 and FIG. 10 shows that the jack up can have at least three supporting feet, 111, 112, 113 and optionally 115 on the frame 109.

Returning to FIG. 1, it can be seen that a usable jack up rig 100 has at least a part of power production equipment 108 arranged in the frame 102 and at least a part of drill and well intervention equipment 110 arranged in the frame 102. As can be seen in this Figure, the feet of the jack up rig can be moved vertically with respect to the frame by means of lifting devices 114. In addition, the feet are moveable from a standby position in which said feet are elevated for transportation of the jack up rig 100 and a working position in which the feet support said frame on the sea bottom 116.

The jack up rig 100 as shown in FIG. 1, has a cantilever 10 on a platform 12 adapted to pivot and to slide or be wheeled along an x-y axis.

FIG. 2 shows a side view of the tower 14 according to the present invention. In the description below the term tower 14 will always be used, but it must be understood that any other suitable device, such as, for example, a derrick 15 as shown in FIG. 6, could also be used. In the present invention the tower 14 is a tubular single structure.

The trolley 22 can move along a guide relative to the tower 14 as shown in FIG. 2. The guide can be a pair of rails 52, 53 of which only rail 52 is visible. On the bottom side the trolley 22 can be provided with a holding member, such as a bail, 24, or some other suitable means, to which a load to be hoisted can be attached. FIG. 2 shows the case in which a top drive 70 with a drill string made out of tubulars 30 fixed below it is attached to the holding member. On the top side, the trolley 22 is provided with three fixed cable pulleys 80, 82 and 84 are shown. At least one loose pulley 88, communicates the hoist cable to the trolley 22 and holding member.

In addition to the above mentioned pulleys, FIG. 3 shows the most preferred embodiment of the splittable block wherein at least four loose pulleys 86, 88, 90, and 92 are also present in the hoisting device. These loose pulleys 86, 88, 90, and 92 may be attached as desired to the tower 14. The splittable block also includes the fixed pulleys 80, 82, and 84. In the invention is preferred that a first end 25 of the hoist cable 26 to be fixed at a fixed point, the second end 27 being rolled up on a second hoist winch 17.

The hoisting winches are preferably driven by electric motors. In one example, each side of the hoisting winch can be provided with such a motor. Alternatively, each hoisting winch can be driven by two electric motors, preferably having a low inertia.

Figure 4:
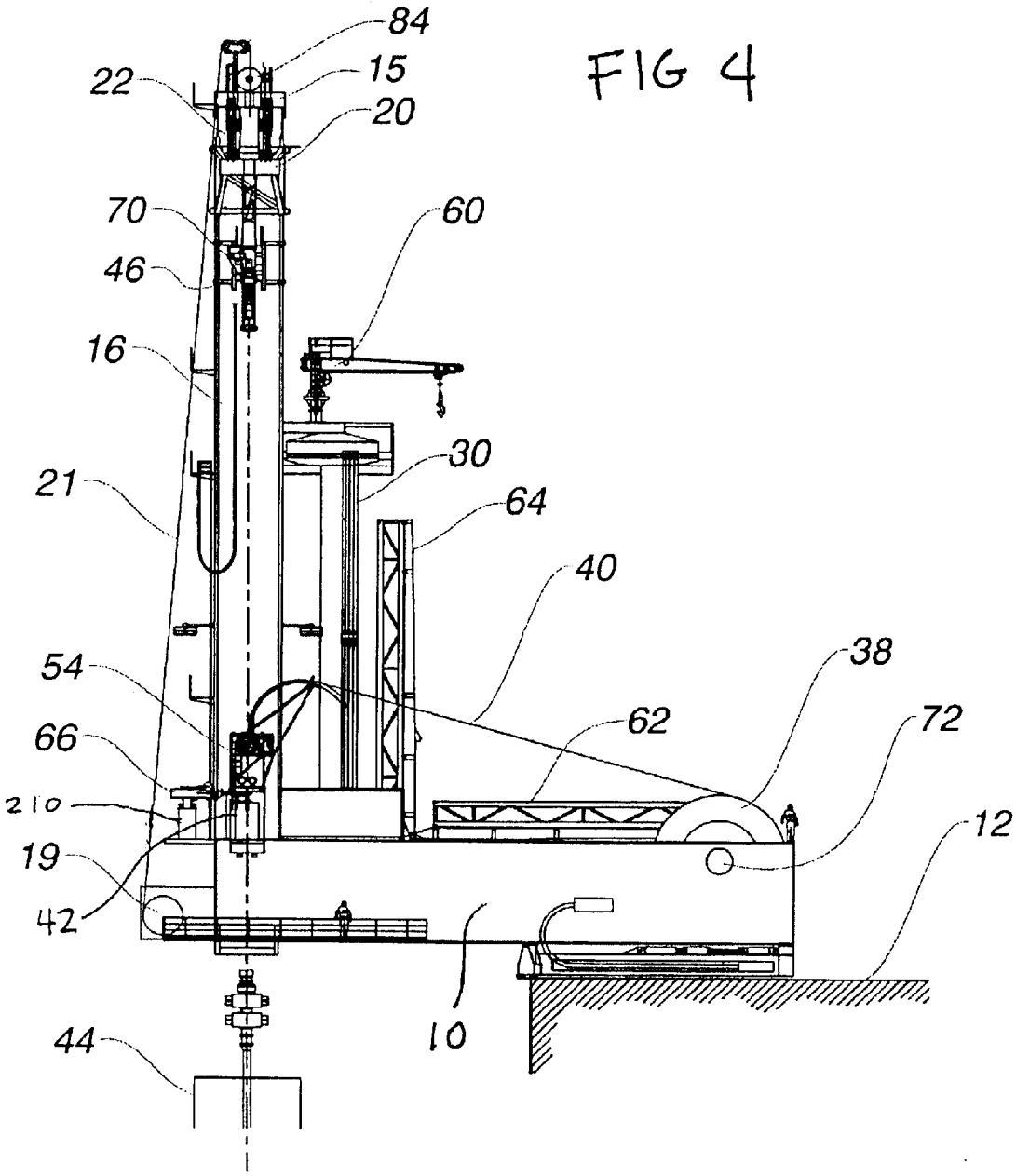
FIG. 4 is a side view of the cantilever with the novel multipurpose system disposed on a tubular mast.

FIG. 4 shows a side view of the cantilever 10 with the novel multi purpose system disposed on a tubular mast 16. FIG. 4 shows the optional embodiment using a third winch, a downhole assembly retrieval winch 19 that can be fixed to the tower 14 or the cantilever 10. These down hole assembly winch can be used to retrieve casing drilling bits, motors and measurement while drilling tools as well as position survey tools, coring barrels, and various well cementing or completion equipment. A cable or wire line 21 can attach to the downhole winch 19 and the cable may be as long as 30,000 feet is run over the top of the tower 14 through the splittable block 20 and down to the bottom of the hole or well 44. FIG. 4 also shows one of the fixed pulleys 84, a spare crane 60, a lifting table 64, a transportable tubular container 62 for holding and receiving tubulars and a reel drive mechanism 72. Additionally, a tubular make-up/break out device is shown which is usable on the jack up rig or platform that utilizes the novel system and methods described herein.

Figure 5:
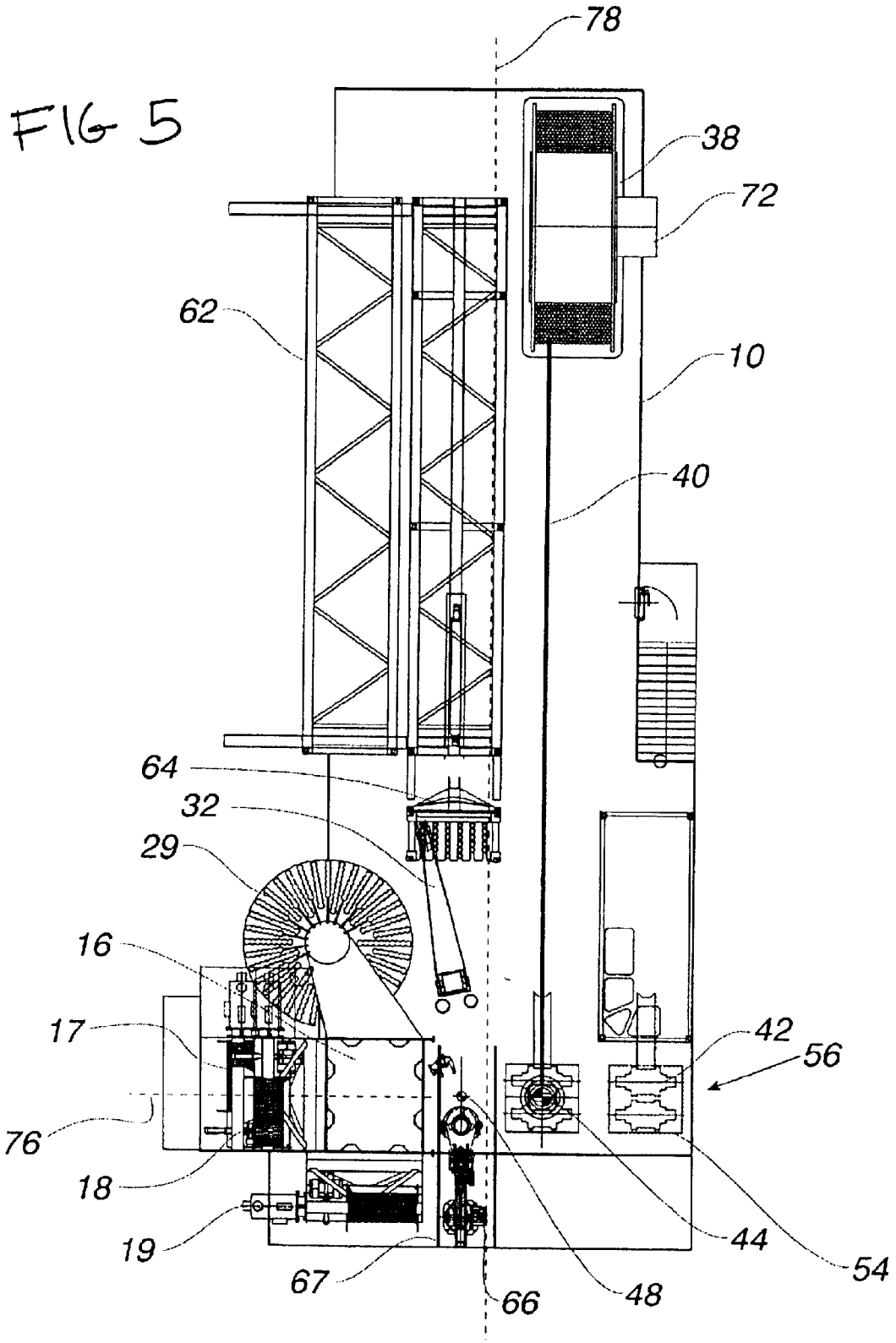
FIG. 5 is a top view of the cantilever with the multipurpose system of the invention.

FIG. 5 shows a detailed top view of the cantilever 10 with the multipurpose system of the invention. The orientation of the tower 14 is shown with the front side facing the well center or with tower axis 76 perpendicular to the cantilever axis 78 of cantilever 10.

At the back side of the tower 14 the draw works comprising of first winch 18 and second winch 17 can be seen. By attaching the draw works at the side facing away from the cantilever valuable deck space is gained. The storage device in this embodiment is a setback drum 29. Other methods of storing tubulars can be used. The setback drum 29 is attached to tower 14 and mounted on cantilever 10. Also a tubular make-up/break out device 66 is mounted on cantilever 10. In a preferred embodiment the tubular make-up/breakout device 66 is a power tong such as manufactured by Weatherford.

FIG. 5 shows that tubular make-up/breakout device 66 can reach both well 44 center and mouse hole 48. Tubular strings can be made up using the tubular make-up/breakout device 66 at the mouse hole 48 while continuing coiled tubing 40 and other operations at the well 44. It is also possible to breakout/make-up tubulars strings at the well 44 using the tubular make-up/breakout device 66 when the coiled tubing unit is skidded away.

Since the majority of the operations are done with coiled tubing; installing a fixed top drive 70 is economically not viable. The cantilever 10 and tower 14 are constructed in such a way that when a top drive 70 is needed for drilling operations this top drive 70 can be fitted quickly with a minimum of interference with the ongoing drilling process. This allows the option to rent the top drive 70 for one well operation. It is clear that by not having to buy or rent for long periods a top drive 70 an economical advantage is gained and the cost to construct a well 44 are lowered.

FIG. 6 suggests that according to the invention, coiled tubing 40 is transported to drilling rig on reels 38 using barges and lifted on board the platform 12 using crane 60. Reel 38 is placed inside cantilever 10 and is driven by reel drive mechanism 72. It should be noted that the reel drive mechanism 72 can drive and brake the reel 38. The advantage of placing reel 38 inside the cantilever 10 is that the coiled tubular 40 exiting the reel 38 and going to the movable injector head 42 does not extend to a large height above the deck or surface of cantilever 10.

In applications according to prior art coiled tubing 40 arches upward considerably acting like a barrier for other operations. By placing the reel 38 and the reel drive 72 inside cantilever 10 this problem is minimized and the disturbance of other operations is minimal. Coiled tubulars 40 are fed through movable injector head 42 in a well bore 44. Movable injector head 42 is placed on a skiddable frame 54. Skiddable frame 54 can move the movable injector head 42 from a storage area 210 to the working position above the well center 44. Switching from normal tubular operations to coiled tubing operations takes only a short time leading to a more efficient operation of the drilling rig and less damage to the well 44. Less damage leads to a more productive well ensuring more production.

The injector head 42 is moved to the storage area 210 when jointed tubular operations are being conducted. This allows coil tubing operations to be quickly and safely utilized which in turn allows the use of coil for small operations which normally would have been conducted using jointed pipe. The economic advantage of using coil tubing is the speed in which the tubulars 40 can be run in or out of the well bore. Coil tubulars 30 can typically be run three to five times faster than jointed tubulars 30 which significantly saves rig time decreasing the cost of constructing or maintaining the well 44.

The injector head 42 frame can have the ability to extend or retract in the vertical position increasing or decreasing the distance between the injector head 42 and the rig floor located on the cantilever deck. This ability increases the efficiency when transitioning between a coil tubing operation and jointed tubular operation. This increase in efficiency is created by allowing the coil tubing to be connected to different bottom hole assemblies in a safer and quicker manner by increasing the working height under the grease injector assembly which is the lower most component of the moveable injector head 42.

FIG. 6 shows that the cantilever 10 is fitted with a slot in which a reel drive 72 is present. The reel drive 72 can be moved in vertical direction to accommodate different sizes of reels 38. This is a particularly advantageous feature.

During operation the coil reels 38 can be quickly changed out by using a crane 60. Changing the reels 38 must be done on a regular basis when the coiled tubulars 40 have reached their usable life or a different size of tubulars 30 is to be used. The crane 60 can hoist the reel 38 out of the cantilever 10 and places them on a storage area 210 on the cantilever deck or the platform 10 or directly on a support vessel for transportation to land not shown. Installing a new reel 38 just involves hoisting the reel 38 and lowering it into the slot. In contrast to coiled reel 38 systems of prior art the reels 38 used in this invention do not have a reel drive 72 attached to them. Because the reels 38 are of such a simple design they are less expensive to manufacture adding to the efficiency of the drilling operations.

It is also contemplated that the invention can utilize only one power pack for powering both the top drive 70 and the reel drive 72. The hydraulic power pack can be mainly used to power the coil tubing reel drive 72 since coiled tubing operations are the majority of the operations done. However sometimes an optional rented top drive 70 can be installed to perform drilling operations. Since the coiled tubing unit is not in operation when the top drive 70 is working the hydraulic power lines can be rerouted to power the top drive 70. This decreases the cost to construct the invention because now only one power pack needs to be installed instead of the two power packs that are normally used.

During the operations with the injector over well 44 the retractable trolley 46 retracts to a position over the mouse hole 48 shown in FIG. 5, and can then be used in conjunction with the racking arm 32, the tubular make-up break-out device 66 and the racking drum 29 and/or lifting table 64. The tubular make-up break-out device 66 can be manual operated or powered and can be deployed from a cable, a retractable arm or mounted on a skiddable frame 54 which runs on rails as previously mentioned, attached to the cantilever deck. The use of these equipments allows jointed tubulars 30 as shown in FIG. 4 and FIG. 6 to be connected into stands and set back in the drums or broken into single joints and laid down onto the cantilever 10 or placed in vertical tubular containers 62 of FIG. 5 which can then be laid down using the lifting table 64. This invention saves considerable rig time, increasing operational efficiency by removing such operations from the critical path of the well construction or maintenance program.

During coiled tubing operations stands of tubulars 30 can be made up or broken apart and the retractable trolley 46 in a retracted position. It is contemplated that the stands of tubular can be casing, drill pipe, completion tubing, down hole equipment and other tubulars 30 that need to be used in the well bore. This saves considerable time because the equipment needed for the next phase of the operation can be prepared in advance and used directly when needed.

As noted in FIG. 6, a spare crane 60 can be used. It is particularly advantageous to use the crane when parts of the tubular handling equipment on the cantilever 10 fail. The spare crane 60 acts as a backup crane for the racking arm and racking drum previously described with which operations can be continued although at a lower speed.

It is contemplated that the spare crane 60 can also used to lower or retrieve special tools and equipment to and from the drill floor More than one crane can be installed on this rig, as shown in FIG. 1, to lift tubular containers 62 on board the drilling platform 12. Tubular containers 62 are connected to lifting table 64 which lifts the containers 62 into vertical position. Once in vertical position the containers 62 behave like fingerboards as commonly are used in the drilling industry. Using a crane 60, tubulars 30 can be picked out container, placed into rotating setback drum or moved directly to well center. Tubulars 30 which come out of the hole either are placed in the rotating setback drum or placed into container directly.

It is contemplated that spare crane 60 can be mounted on the tower 14, the vertical storage device 28 or any other suitable place on the cantilever.

During the drilling process maintaining a continuous supply of tubulars 30 is an important factor for the efficiency of the drilling operations. In some situations it can be advantageous to have additional horizontal tubular storage containers 56 as shown in FIG. 5.

On the cantilever 10 there is a spare location next to the lifting table 64 where a container can be temporarily stored. This has the advantage that when a new container is needed there is no time lost by first having to lift the previous one of the cantilever 10 and then lifting the new one on the lifting table 64. Instead after lowering the container to a horizontal position the container just slides to the storage position and a new container is lifted on the lifting table 64. The container in the storage position can be lifted of the cantilever 10 off-line out of the critical time-path thereby no interference with the continuous supply of tubulars 30 to the firing line.

In an embodiment of the invention, a racking arm 32 can be used to lift tubulars 30 from a position horizontal to the cantilever 10 to a vertical position if system is being used without tubular containers 62.

FIG. 7 shows a detailed front view of a splittable block 20 usable with the inventive multipurpose system with all the loose pulleys 86, 88, 90, and 92 connected to the trolley 22. The FIG also shows the use of holding member 24 attached to the trolley 22 over the well 44.

FIG. 8 shows a detailed front view of a splittable block 20 according to the invention with only two loose pulleys 86, 88, 90, and 92 and two fixed pulleys 80, 82, and 84 connected to the trolley 22. This FIG also shows the use of holding member 24 attached to the trolley 22 over the well 44 with the hoist cable 26.

FIG. 9 is a top view of the platform 12 showing the multipurpose system can pivot about a central point 128 on a platform 12. The cantilever 10 placed on the platform 12 is supported by a jack up 100. The cantilever is movable in its longitudinal direction as indicated by the arrow A, and in its transverse direction as indicated by the arrow F. In an alternative embodiment, the cantilever 10 can rotate around an axis indicated by the arrow G. A plurality of storage devices, such as vertical storage devices are shown 28 and 28*a*. The maximum angle for rotation is contemplated as to 45 degrees. The moving function of the cantilever 10 can be rolling or skidding.

FIG. 10 shows a top view of the platform with the cantilever on rails which can slide or skid in the direction of arrow A, or alternatively in the direction of arrow B.

The invention is also a method for drilling a well and for well intervention using the multipurpose system 8 on a pivoting, slidable cantilever 10 on a platform to drill a well 44 and to perform well intervention operations. The pivoting, slidable cantilever 10 is adapted to pivot and slide along an x-y axis. The method begins by pulling a completion tubing 31 out of the well 44, forming segments 33 from the completion tubing pulled from the well 44, setting back the segments 33 into the storage area 29 on the cantilever 10, and running the coiled tubulars 40 into the well 44.

The method continues by removing used completion equipment in the well 44 and preparing the well 44 for new completion equipment with the coiled tubulars 40. While preparing the well 44 for the new completion equipment, segments of new completion tubing are pulled from the storage area 29 and the segments of new completion tubing are broke into individual joints. The individual joints are, then, removed from the pivoting, slidable cantilever 10.

Next, the method entails running into the well 44 with coiled tubulars 40 and installing the new completion equipment 204. While installing the new completion equipment in the well 44, the segments of new completion tubing 202 are built from individual joints and the segments of new completion tubing 202 are set in the storage area 29. The method ends by running the segments of new completion tubing 202 and the new completion equipment 204 into the well 44.

The invention is also a method for drilling a well using a multipurpose system 8 on a pivoting, slidable cantilever 10 on a platform to drill a well and to perform well intervention operations. Again, the pivoting, slidable cantilever 10 is adapted to pivot and slide along an x-y axis 78, 79. The method begins by running casing 97 directly into the well 44 from the storage area 29. When the casing 97 is in the well 44, a drilling assembly 96 is run on a hoisting cable 26 98 and latching into the casing 97.

Next, the method entails connecting a top drive 70 to the casing 97 and drilling the well 44. After drilling the well 44 to a casing 97 setting depth, a hoisting cable 26 is run into the well 44 and the drilling assembly 96 is retrieved. The method continues by cementing the casing 97 in the well 44, running the coiled tubulars 40 into the well 44 and the drilling assembly 96, drilling a production well section 200 and removing the drilling assembly 96 from the well 44 using the coiled tubulars 40, and installing the well 44 completion with the coiled tubulars 40.

While drilling the production well section 200 and installing the well 44 completion with coiled tubulars 40, segments of new completion tubing 202 and new completion equipment 204 are built and the segments of new completion tubing 202 and the new completion equipment 204 are placed into the storage area 29. The method ends by running the segments of new completion tubing 202 and the new completion equipment 204 into the well 44.

In an alternative embodiment, the method can further include the step of running casing 97 directly into the well 44 from the storage device 28. The methods can also entail the step of lifting the storage device 28 filled with casing 97 to the vertical position in the storage area 29. The methods can be adapted to allow multiple hole sections to be drilled.

The step of connecting a top drive 70 to the casing 97 and drilling a production well section 200 can use at least one casing segment 206 pulled directly from the storage device 28. The new completion tubing 202 can be run directly from the storage device 28 and The new completion tubing 202 can also be run directly from the vertical storage device 28.

The step of running casing 97 directly into the well 44 from the storage device 28 can use using the racking arm 32. Also, the step of building the segments of new completion tubing 202 and the new completion equipment 204 can use a crane 58, a plurality of tubular containers 62, a lifting table 64, a makeup/breakout device 66, and combinations thereof.

The storage area 29 can also be used for the horizontal storing of tubulars, segments, and completion equipment.

In another embodiment, the step of running the segments of new completion tubing 202 and the new completion equipment 204 into the well 44 can be performed using the trolley 22 which centered over the well 44 in its first position 81.

The plurality of reels, plurality of storage areas, and/or plurality of splittable block can be used with any of the methods.

The invention is also method for using a pivoting, slidable cantilever 10 on a jack-up rig. The method involves moving the jack up rig to a well, moving the legs of the jack up rig enabling the legs to engage the sea bottom, and preloading the jack up rig and jacking the rig to the correct height above the water surface. The method ends by skidding a rotating pivotable cantilever 10 to a position over the side of the jack-up rig, moving the rotating pivotable cantilever 10 directly over the well 44, and, then, initiating operation of the cantilever 10 using the multipurpose system 8.

In an alternative embodiment, it is contemplated that one trolley system could be used with the invention which performs both the functions of the trolley 22 and the retractable trolley 46.

The foregoing disclosure and description of the invention are illustrative and explanatory thereof and various changes in the method and system and in the size, shape and materials, as well as in the details of the illustrated construction, may be made within the scope of the claims without departing from the spirit of the invention.

What is claimed is:

1. A multipurpose system for a drilling and well intervention comprising:

a. a pivotable, slidable cantilever on a platform adapted to pivot and to slide along an x-y axis;

b. a tower disposed on the cantilever comprising:

i. a mast;

ii. a hoist winch;

iii. a splittable block connected to the mast;

iv. a trolley comprising a holding member wherein the trolley is moveably mounted to the mast and the splittable block;

v. a hoist cable having a first end and a second end wherein the first end is connected to the hoist winch and the hoist cable passes over the mast through the splittable block to the trolley;

c. a storage area with a storage device for storing tubulars;

d. a racking arm secured the pivotable, slidable cantilever and secured with a beam to the tower for moving tubulars;

e. a reel comprising coiled tubulars;

f. a moveable injector head for running and retrieving coiled tubulars from the reel; and g. a retractable trolley moveably mounted on the mast with a holding member and adapted for positioning the tubulars over a well and over an additional work area.

2. The system of claim 1, wherein a plurality of storage devices are used.

3. The system of claim 1, wherein a plurality of reels are used.

4. The system of claim 1, wherein a plurality of splittable blocks are secured to the mast.

5. The system of claim 1, wherein the storage device is a vertical storage device.

6. The system of claim 1, wherein the racking arm is a horizontal to vertical racking arm.

7. The system of claim 1, wherein the storage area is for the horizontal storing of tubulars.

8. The system of claim 1, wherein the tower is selected from the group consisting of a derrick and a tubular mast.

9. The system of claim 1, wherein the tower further comprises a pair of rails disposed on the tower wherein the rails are parallel to each other and the retractable trolley and the trolley are disposed on the rails.

10. The system of claim 1, further comprising a skiddable frame removably mounted on the cantilever.

11. The system of claim 10, wherein the moveable injector head is mounted on the skiddable frame.

12. The system of claim 10, wherein the skiddable frame and the moveable injector head are movable between the well and a standby position on the cantilever.

13. The system of claim 10, wherein the skiddable frame can be vertically extended and retracted to increase or decrease the vertical distance between the movable injector head and the cantilever.

14. The system of claim 1, wherein the storage device is a racking drum.

15. The system of claim 1, further comprising a crane disposed on the platform.

16. The system of claim 15, further comprising a spare crane.

17. The system of claim 16, wherein the spare crane is mounted on the tower.

18. The system of claim 15, wherein the spare crane is mounted on the racking arm.

19. The system of claim 15, wherein the spare crane is mounted on a racking drum.

20. The system of claim 1, further comprising transportable tubular containers as the storage device.

21. The system of claim 20, further comprising a lifting table disposed on the cantilever for moving the transportable tubular containers to a position vertical to the cantilever.

22. The system of claim 1, further comprising a tubular makeup/breakout device disposed on the cantilever and adapted for making up strings of tubulars.

23. The system of claim 1, further comprising a top drive attached to the retractable trolley.

24. The system of claim 1, further comprising a reel drive mechanism for engaging the reel.

25. The system of claim 1, wherein the platform is a member of the group consisting of a barge, ship, a jack up platform, other floating vessels, and a fixed leg platform.

26. The system of claim 1, wherein the cantilever is mounted on wheels.

27. The system of claim 1, wherein the cantilever pivots on the deck of the platform up to 45 degrees from the position of the tubulars over the well.

28. The system of claim 1, wherein the cantilever has a longitudinal axis and the tower is positioned perpendicular to the longitudinal axis of the contilever.

29. The system of claim 1, wherein the cantilever has a longitudinal axis and the tower is positioned parallel to the longitudinal axis of the cantilever.

30. The system of claim 1, wherein the tower is modular.

31. The system of claim 1, wherein the splittable block comprises a plurality of fixed pulleys and loose pulleys.

32. The system of claim 31, wherein the splittable block comprises at least two loose pulleys.

33. The system of claim 1, further comprising a down whole assembly retrieval winch for engaging a member of the group consisting of the mast, the cantilever, and the platform.

34. The system according to claim 33, wherein the hoist winch and the down hole assembly retrieval winch are each driven by at least one motor with a low inertia.

* * * * *